US005977715A

United States Patent [19]

Li et al.

[11] Patent Number: 5,977,715

[45] Date of Patent: Nov. 2, 1999

[54] HANDHELD ATMOSPHERIC PRESSURE GLOW DISCHARGE PLASMA SOURCE

[75] Inventors: Kin Li; Minas Tanielian, both of Bellevue, Wash.

[73] Assignee: The Boeing Company, Seattle, Wash.

[21] Appl. No.: 08/572,390

[22] Filed: Dec. 14, 1995

[51] Int. Cl.[6] ..... H05B 31/26

[52] U.S. Cl. ..... 315/111.51; 315/111.21; 315/111.81; 219/121.36; 219/121.43; 219/121.48; 219/121.5

[58] Field of Search ..... 219/121.12, 121.15, 219/121.27, 121.34, 121.48, 121.5, 121.43, 121.36; 315/111.51, 111.81, 111.21

[56] References Cited

U.S. PATENT DOCUMENTS

| | | | |
|---|---|---|---|
| 4,422,013 | 12/1983 | Turchi et al. | 315/111.81 |
| 4,629,940 | 12/1986 | Gagne et al. | 315/111.51 |
| 4,682,026 | 7/1987 | Douglas | 250/288 |
| 4,849,675 | 7/1989 | Müller | 315/111.51 |
| 4,887,005 | 12/1989 | Rough et al. | 315/111.21 |
| 4,931,700 | 6/1990 | Reed | 315/111.81 |
| 5,079,482 | 1/1992 | Villecco et al. | 315/111.81 |
| 5,216,330 | 6/1993 | Ahonen | 315/111.51 |
| 5,285,046 | 2/1994 | Hansz | 219/121.47 |

FOREIGN PATENT DOCUMENTS

| | | | |
|---|---|---|---|
| 0175651 | 8/1987 | Japan | 315/111.51 |

*Primary Examiner*—Arnold Kinkead
*Attorney, Agent, or Firm*—Conrad O. Gardner

[57] ABSTRACT

A handheld atmospheric pressure glow discharge plasma source is provided without the use of an arc. The plasma is induced using a radio frequency signal. An LC resonator in the handheld source with a gain of about 10 at 13.56 MHZ improves the power transfer from a power supply and tuner to the plasma chamber which is capable of producing stable plasmas in Ar, He and $O_2$ mixtures.

3 Claims, 3 Drawing Sheets

HANDHELD ATMOSPHERIC PRESSURE GLOW DISCHARGE PLASMA SOURCE

BACKGROUND OF THE INVENTION

Atmospheric pressure (hot) plasmas caused by a DC arc have been known since the dawn of man. A common example is lightning. An industrial application of a DC arc plasma is a plasma gun, which is used in various manufacturing environments for forming coatings (typically ceramic materials).

Low pressure, glow discharge type (cold) plasma processes have been known for over a hundred years. As a matter of fact, most of current microelectronic material processing techniques use some form of low pressure plasma as their working environment.

In contrast, the present source provides a glow discharge atmospheric pressure (cold) plasma. Laboratory examples of such systems can be found in the literature: (1) Hideomi Koinuma et al "Development and application of a microbeam plasma generator" in Applied Physics Letters, Vol. 60, p. 816–817, Feb. 17, 1992; and, (2) Kiyoto Inomata et al "Open air deposition of $SiO_2$ film from a cold plasma torch of tetramethoxysilane-$H_2$—Ar system" in Applied Physics Letters, Vol. 64, p. 46–48, January 1994. In the above referenced cases, the plasma is obtained by a continuous capacitive discharge at high voltage. Due to the small capacitance and very high impedance of the discharge tube, matching the load to a power supply with a typical matching network is difficult to realize. The conditions for enabling the production of a glow discharge plasma described in these papers are forced and to some degree, undesirable. To achieve a glow discharge a cabling configuration was designed which utilized a commercially available tuning network and boosted up power without very efficient power coupling.

The patent literature includes: U.S. Pat. No. 5,079,482 to Villeco et al. which discloses an electron beam discharge device which has an LC circuit formed by the secondary coil 30S of the Tesla coil 30 and the distributed capacitance 40A. This LC combination is located at the electron discharge gun 24.

U.S. Pat. No. 4,442,013 to Turchi et al. discloses a cold plasma-gun which has inductors 35, 50, 64 and capacitors 56, 30, 70 at the beam discharge.

U.S. Pat. No. 5,216,330 to Ahonen discloses an ion beam gun which discharges a cold plasma and which has an inductor 230 and capacitor 324 (see FIG. 4) at the beam discharge.

U.S. Pat. No. 5,285,046 to Hansz discloses an ion deposition source which has a pair of LC circuits (16a, 20a; 16b, 20b; see FIG. 4) driving the plasma discharge.

U.S. Pat. No. 4,931,700 to Reed discloses an electron beam gun which has an LC resonator (see FIG. 1) formed by inductor 7S and capacitor 5 driving the electron gun 10.

U.S. Pat. No. 4,849,675 to Mull discloses an ion beam gun which discharges a cold plasma and which has an inductor 2 and capacitor 15 (see FIG. 2) at the beam discharge; and, U.S. Pat. No. 4,629,940 to Gagne et al. discloses a cold plasma generating torch which has an LC resonator formed by an inductor 28 and capacitors 66, 70 driving the discharge.

SUMMARY OF THE INVENTION

The present hand-held plasma gun is intended for very low power applications (less than 100 watts), utilizes a glow discharge (cold) plasma (gas temperature about 100 C.). The plasma source disclosed in this invention uses two matching networks. The first matching network is connected to the output of the RF power supply. The second matching network is actually an LC resonant circuit which integrated with the capacitive discharge tube at the plasma source. The coupling between the two matching networks is a coaxial cable. The voltage present at the cable is low (less than 400 volts), and the transfer of power from the power supply to the discharge tube is very efficient.

DETAILED DESCRIPTION OF THE INVENTION

Figure 1:
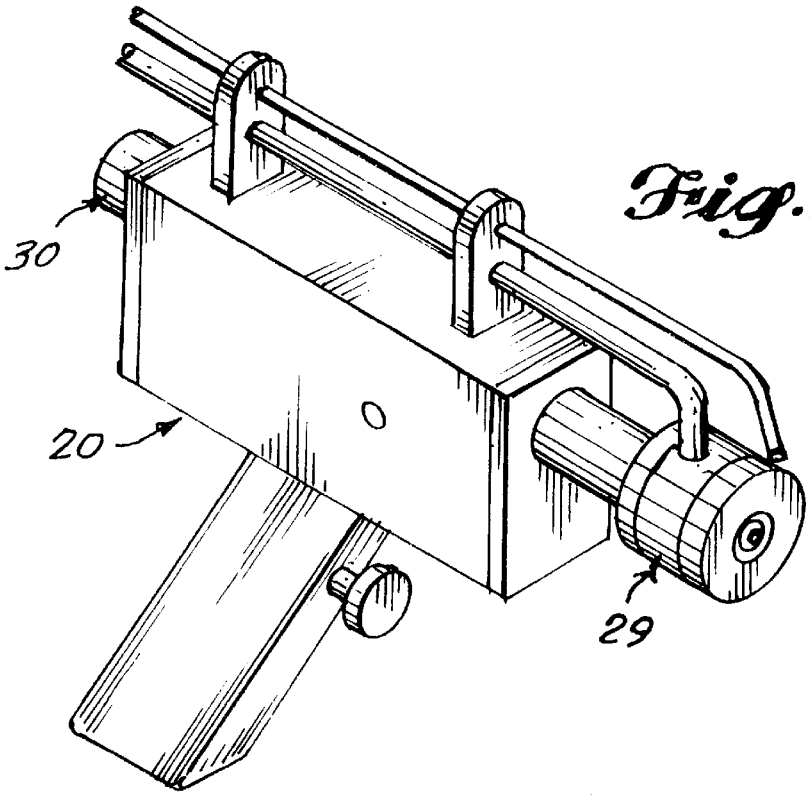
FIG. 1 is a perspective view of a preferred embodiment of a handheld atmospheric pressure glow discharge plasma source in accordance with the present invention.
Figure 2:
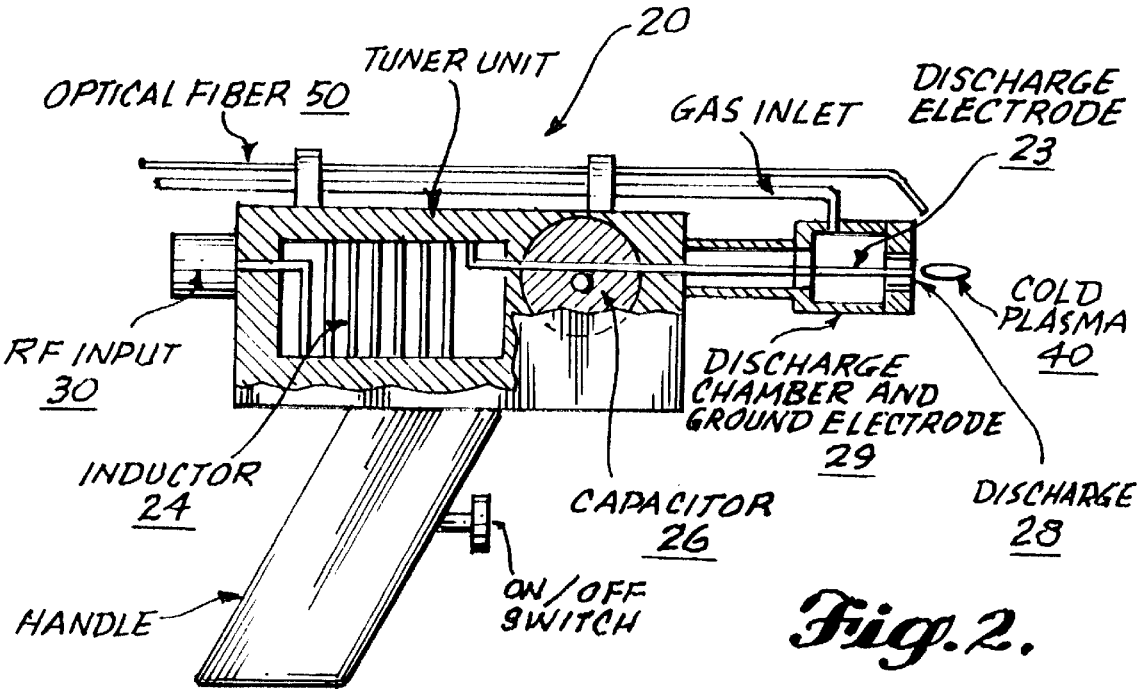
FIG. 2 is a schematic representation of a cross sectional view of the handheld atmospheric pressure glow discharge plasma source.

The present gun-shaped atmospheric pressure glow discharge plasma source 20 provides an atmospheric plasma source without the use of an arc. The plasma 40 is induced by the use of an RF signal 30.

An LC circuit 24, 26 is connected to the plasma discharge tube 28. This configuration is not critically dependent on the length of cable 32 or the capacitance/inductance of the specific cable. This added LC resonant circuit 24, 26 serves two functions, (1) it transforms the high impedance of capacitive discharge tube 28 to a low impedance that can be matched by RF power supply and network 25, 34 and (2) it steps up the input voltage to help start the plasma and it enables very efficient use of power coupling so that the plasma can be sustained with only a few watts. It also allows the use of a variety of gases to sustain a glow discharge plasma while an inefficient unit could only do so with a selected few (e.g. helium mixtures; in contrast the present system sustains a plasma of pure Argon).

The present gun-shaped atmospheric pressure glow discharge plasma source 20 due to circuit efficiency and compactness permits scaleup to a matrix of guns thereby allowing applications on large areas or odd-shaped parts through scanning or movement of the object. An optical fiber 50 is disposed parallel to the central axis of gun 20 looking into cold plasma 40. By so examining the spectra of the effluents, gun 20 can be automated to do end-point detection and automatic process control.

Figure 3:
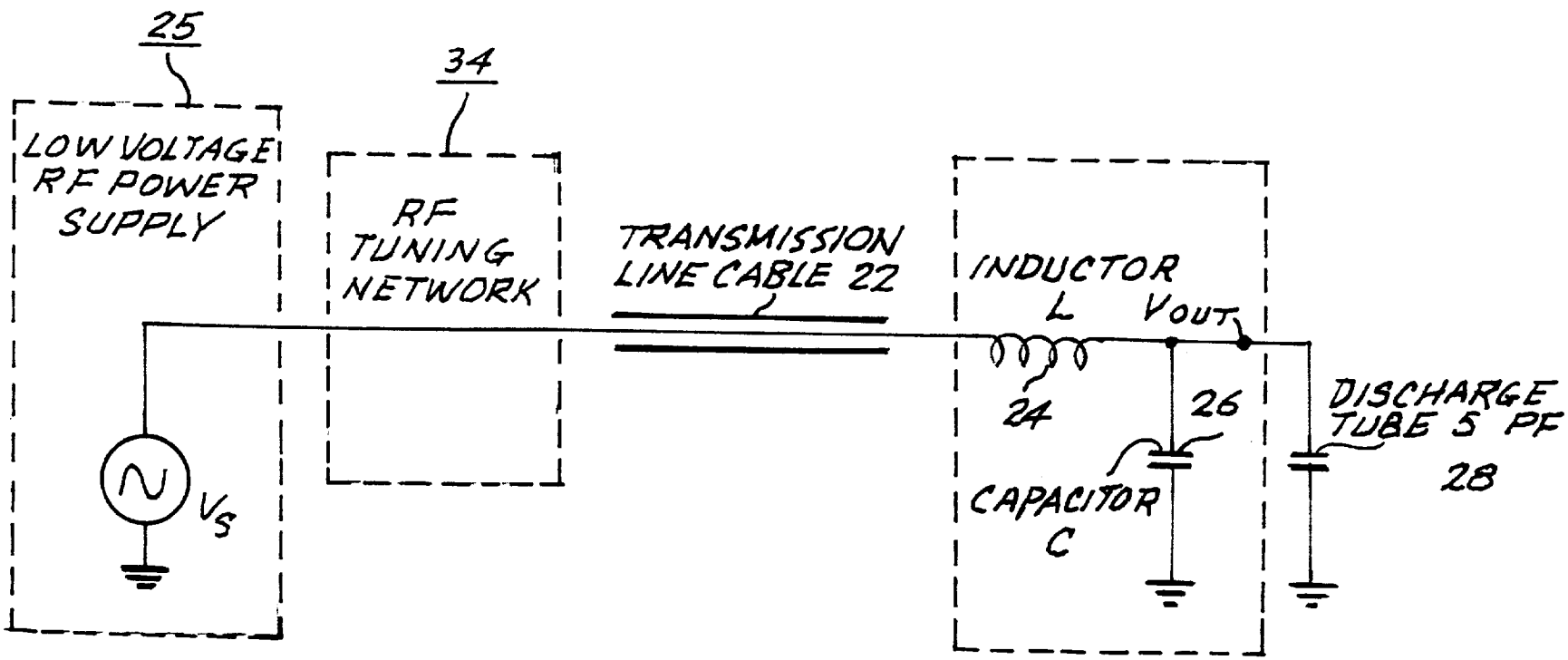
FIG. 3 is the equivalent electrical diagram connecting the power supply to the plasma discharge source.

Turning to FIG. 3 it can be seen that the present plasma discharge system is comprised of a low voltage RF power supply 25 (less than 400 volt), a matching tuner 34, a low voltage 50 ohm transmission line cable 32, a handheld plasma source 20 (a voltage multiplier or resonator, and a discharge chamber 29 which comprise the handheld discharge gun). The discharge chamber 29 acts as a ground electrode. The added LC voltage multiplier 24, 26 in proximity to the discharge chamber 29 eliminates the requirement of having the connecting cable 32 and the matching network tuner 34 act as a means for reducing the value of the voltage required to produce a stable glow discharge plasma at atmospheric pressure as reported in Koinuma et al. and Inomata et al. Furthermore, being able to sustain a stable glow discharge at atmospheric pressure using low power and low voltage allows for the use of the plasma discharge source by a battery operated, compact, and low weight power supply 25 and tuner 34.

In one of the preferred embodiments, discharge source 20 has a 6 microhenry inductor coil 24 and a 25 pF capacitor. The discharge chamber 29 capacitance in this embodiment is less than 0.1% of capacitor 26.

Figure 4:
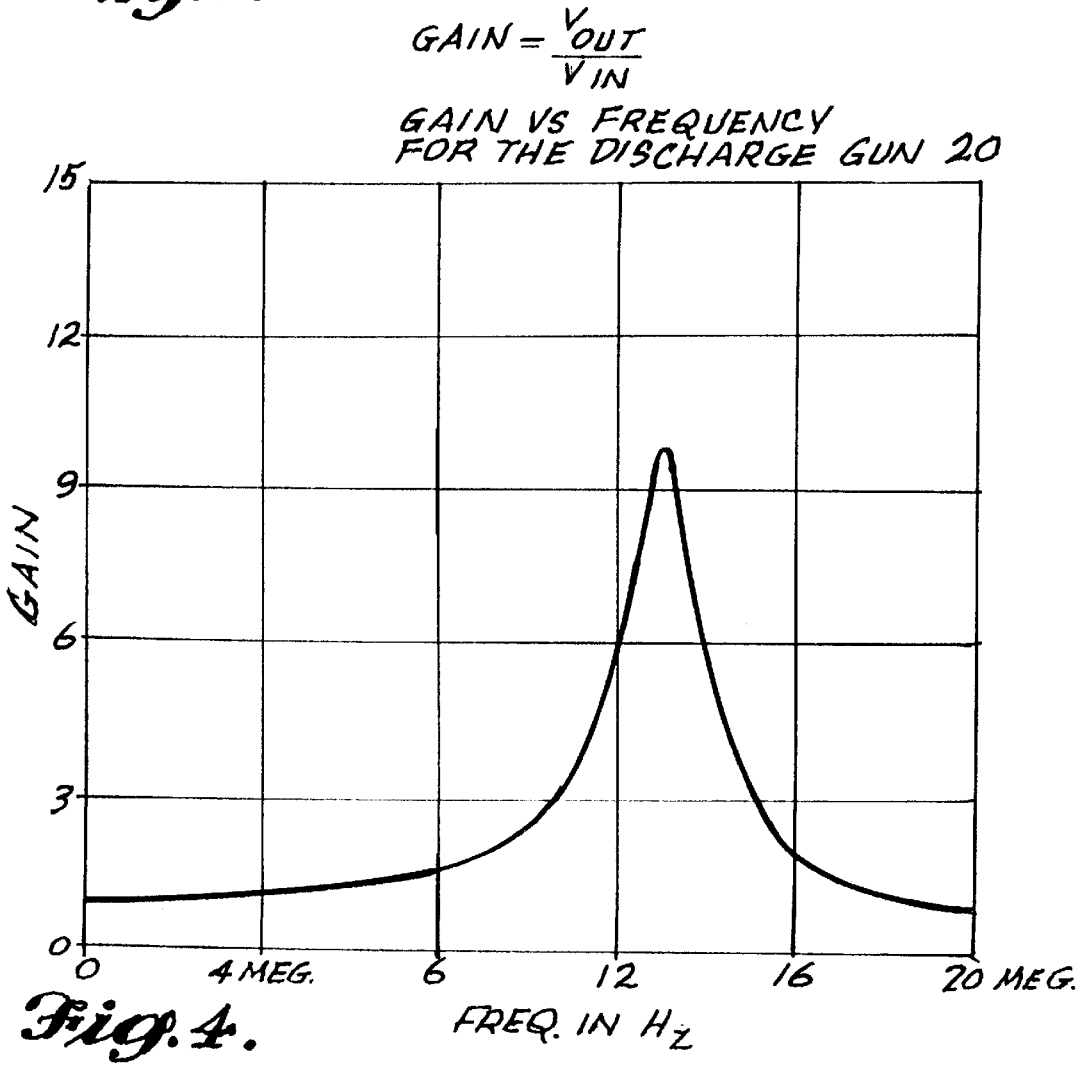
FIG. 4 is a graph showing gain vs. frequency of the present plasma source.

The LC resonator (24, 26) in gun 20 is designed to operate at 13.56 MHz which is a frequency allocated by ICC for industrial RF applications. The voltage gain shown in FIG. 4 is the ratio of Vo/Vi, where Vo is the output voltage and Vi is the input voltage in the resonant circuit. The gain shown is about 10 at 13.56 MHz. The matching tuning network 34 has 1 $\mu$H inductor and a 250 pF variable capacitor in parallel with a 0.3 $\mu$H inductor and 500 pF variable capacitor. This is used to transform the load to 50 ohm for best power transfer from the power supply 25.

Preferred Embodiment Electrode Design

Discharge source 20 uses a discharge electrode 23 and a ground electrode which is the discharge chamber 29. The discharge electrode 23 which is 0.040 inches in diameter. This electrode size results in a stable plasma over a wide range of operating parameters (5–50 Watts typically). It was observed that the tip of the electrode becomes very hot during operation at high power levels or low feed gas flow rates. The metal used in the electrode should have a high electrical conductivity and a high thermal conductivity e.g. gold plated brass or platinum.

A number of electrode sizes were tested: A small diameter electrode (0.015 inch) was capable of sustaining plasmas over a similar range of power range. However, when operated at the higher power levels the electrode was physically sputtered by the glow discharge which is undesirable. A larger diameter electrode (0.092 inch) was tested and it was determined that it could sustain stable plasmas, but over a much smaller operating range than the smaller electrodes. Specifically, it was impossible to strike and maintain plasmas at high power levels due to arcing. This arcing was never observed in the small (0.015 inch) electrodes, and rarely observed in the preferred (0.040 inch) electrodes. Also, when the large diameter electrode was used, it was much easier for the electrode tip to arc to the sample substrate 62. This is of importance for usage in any industrial applications.

Figure 5:
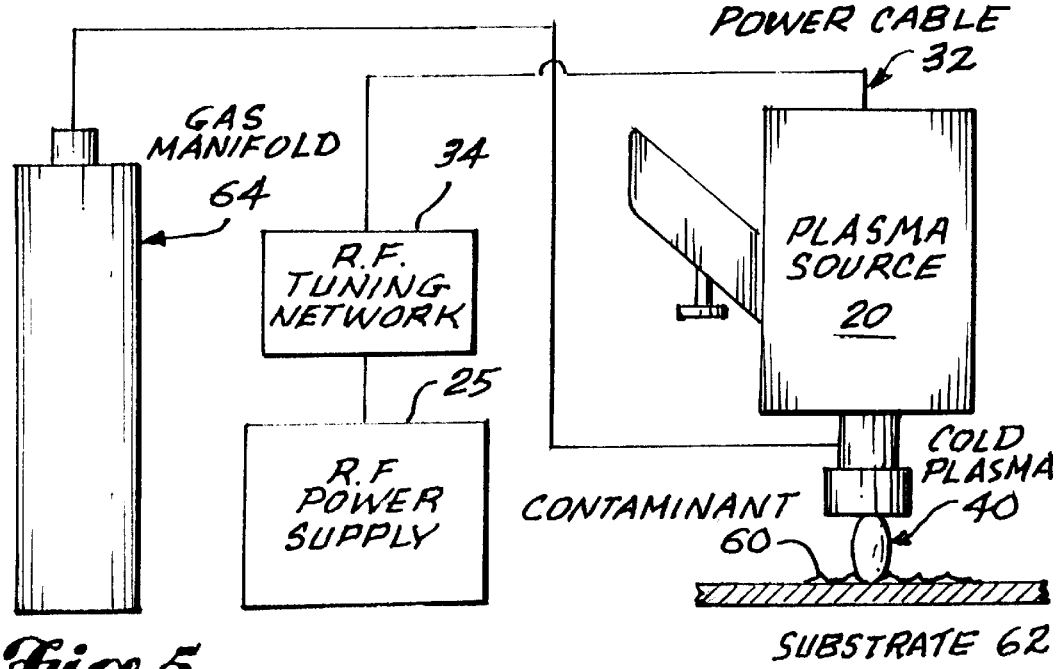
FIG. 5 is a system block diagram illustration of the use of the present plasma source used for surface modification of a substrate material.

FIG. 5 shows the aforementioned plasma source 20 providing cold plasma 40 remove a contaminant 60 from substrate 62.

Plasma source 20 is remotely connected to a rf power supply 25, tuning network 34 and gas manifold 64. One preferred embodiment of the usage of plasma source 20, to remove an organic contaminant is as follows: An operator adjusts the flow of the feed gas from manifold 64 and then gradually increases the applied rf power to the gun. Plasma 40 will then appear at the end of the discharge tube 22 at about 5 watts. The power is then further increased (to between 5 and 50 watts) until a stable column of plasma of about 5 mm to 8 mm tall is achieved. In the preferred embodiment the feed gas is a mixture of a noble gas and oxygen. The operator then directs the column of plasma to organic contaminant 60 on the surface of substrate 62. The contaminant can be located up to 1 centimeter away from in the oxygen containing plasma for removal action to occur. For a large spot, the plasma source needs to be rastered in a pattern until the plasma column passes over the entire area of the contaminant. The end point of the cleaning process is reached when the surface of the substrate material (metal, glass, ceramic etc.) is free of the organic (oil, grease, etc.) contamination.

The present plasma source 20 produces an atmospheric pressure plasma without the use of an arc. The plasma is induced by the use of an rf signal (13.56 MHz). A variety of configurations will produce a stable plasma discharge as long as an appropriate resonant circuit is disposed between the commercially available power supply and tuning network and the discharge chamber 29 within a range of geometrical/electrical values so that tuning of the overall system can be achieved for efficient energy transfer between the power supply and the discharge nozzle 28.

Plasma source 20 may be utilized to remove surface layers of materials or to add a new layer with different properties or chemical composition than the underlying layer or changing the composition and structure of the top layer. This can be done on small size objects and/or large area materials such as sheet metal or formed metal parts by using the appropriate gaseous admixtures to the carrier gas (helium, argon, etc.)

Another method of use of the present apparatus is its usage in the cleaning of various metal or ceramic parts by the removal of organic surface contaminants such as oils. This is unique in the sense that the result can be achieved in an atmospheric environment without any significant heating of the material, in a localized fashion if desirable, independent of the type of the organic material, and without the use of a wet chemical such as a solvent. This is achieved by using a carrier gas with small admixtures of oxygen gas such that the present glow discharge produces atomic oxygen, oxygen radicals and ozone which are chemically very active and will attack any organic material. Again this can be done in small isolated areas such as removing charred flux from circuit boards or in large areas such as stripping paint off metal surfaces by using the appropriate geometrical profile of the glow discharge plasma.

Hereinbefore described atmospheric pressure glow discharge plasma gun 20 has demonstrated the following:

- produced a plasma in pure He gas,
- produced a plasma in He/$O_2$ mixtures,
- produced a plasma in pure Ar gas,
- produced a plasma in pure $O_2$ gas,
- produced a plasma in an Argon/$O_2$ mixture,
- demonstrated that a plasma can be sustained from 5–50 Watts,
- demonstrated a high etch rate of photoresist (about 1 $\mu$m/min at 15 W with about 10% $O_2$ in He),
- demonstrated essentially zero etch rate of photoresist in pure He or Ar gas,
- demonstrated a significant etch rate of Kapton in Ar/$O_2$
- demonstrated an etch rate of epoxy paint in He/$O_2$ and Ar/02.

Other applications of the present method and use for the apparatus described will become apparent to those skilled in the art from an understanding of the hereinabove described specification.

While a preferred embodiment of the invention has been illustrated and described, variations will be apparent to those skilled in the art. Accordingly, the invention is not to be limited to the specific embodiment illustrated and described, and the true scope of the invention is to be determined by reference to the following claims.

The embodiments of the invention in which an exclusive property or privilege is claimed are defined as follows:

We claim:

1. An atmospheric pressure glow discharge plasma source comprising in combination:

a low voltage RF power supply with a matching network tuner;

a coaxial transmission line;

a discharge nozzle for providing plasma flow;

a plasma gun comprising a resonant circuit having a voltage gain of at least 10;

said plasma gun coupled between said discharge nozzle and said coaxial transmission line; and, said low voltage power supply with said matching network tuner coupled to said coaxial transmission line upstream from said plasma gun.

2. A cold atmospheric glow discharge plasma source comprising in combination:

a discharge nozzle for establishing a plasma flow;

said discharge nozzle having a capacitance of about 5 femtofarads;

a plasma gun having a resonant circuit, consisting of a LC circuit, wherein L equals about 6 micro henries and C equals about 25 picofarads for providing a voltage gain of about 10;

said plasma gun connected to said discharge nozzle and an RF power supply and matching network connected upstream from the plasma gun.

3. A cold atmospheric pressure plasma apparatus according to claim 2 further including an optical fiber disposed parallel to the central axis of said plasma gun.

* * * * *